US007213432B2

(12) United States Patent
Rosenthal et al.

(10) Patent No.: US 7,213,432 B2
(45) Date of Patent: May 8, 2007

(54) HOT ROLLING INSTALLATION

(75) Inventors: Dieter Rosenthal, Niederfischbach (DE); Peter Sudau, Hilchenbach (DE); Joachim Hafer, Siegen (DE)

(73) Assignee: SMS Demag AG, Düsseldorf (DE)

( * ) Notice: Subject to any disclaimer, the term of this patent is extended or adjusted under 35 U.S.C. 154(b) by 480 days.

(21) Appl. No.: 10/486,410

(22) PCT Filed: Aug. 5, 2002

(86) PCT No.: PCT/EP02/08715

§ 371 (c)(1),
(2), (4) Date: Jun. 28, 2004

(87) PCT Pub. No.: WO03/013750

PCT Pub. Date: Feb. 20, 2003

(65) Prior Publication Data

US 2004/0232605 A1 Nov. 25, 2004

(30) Foreign Application Priority Data

Aug. 7, 2001 (DE) ..... 101 37 944

(51) Int. Cl.
*B21B 1/46* (2006.01)

(52) U.S. Cl. ..... 72/226; 72/200; 72/236; 29/527.7

(58) Field of Classification Search ..... 72/201, 72/202, 226, 227, 236, 39, 40; 29/527.5, 29/527.6, 527.7; 164/417, 476
See application file for complete search history.

(56) References Cited

U.S. PATENT DOCUMENTS 5,611,232 A * 3/1997 Rohde et al. ..... 72/202
5,802,902 A * 9/1998 Rosenthal et al. ..... 72/201
5,910,184 A * 6/1999 Kneppe et al. ..... 72/201
5,991,991 A * 11/1999 Pleschiutschnigg ..... 29/33 C
6,062,055 A * 5/2000 Bobig et al. ..... 72/201
6,216,770 B1 * 4/2001 Hensger et al. ..... 164/476

(Continued)

FOREIGN PATENT DOCUMENTS

DE 4402402 8/1995

(Continued)

OTHER PUBLICATIONS

Ameling D: Advanced Steelmaking and Rolling . . . , Stahl und Eisen, Verlag . . . Dusseldorf, DE, BD. 120, No. 9, Sep. 2000, pp. 27-32.

*Primary Examiner*—Dmitry Suhol
(74) *Attorney, Agent, or Firm*—Friedrich Kueffner

(57) ABSTRACT

A hot rolling installation should be constructed and able to be operated so that strips of materials, which can be shaped with different levels of difficulty and have a thickness of less than 1 mm, can be rolled. According to the invention, strip speeds of 15 m/sec should not be exceeded at the outlet of the last roll stand regardless of the material being used, and the hot-rolled strip should have austenitic structures. To this end, the invention provides that thin slab thicknesses of approximately 50 mm are used for easily shapeable material, that the first of seven stands is driven or executes only a smoothing pass, the slab is de-scaled in front of and behind the first stand, and that the second to seventh stand effects the reduction in thickness to less than 1 mm.

5 Claims, 1 Drawing Sheet

U.S. PATENT DOCUMENTS 6,832,432 B2 * 12/2004 Bald et al. ..... 29/527.7
7,047,621 B2 * 5/2006 Zajber et al. ..... 29/527.7

FOREIGN PATENT DOCUMENTS

DE 198 17 034 A1 10/1999
EP 0870553 10/1998
EP 0885974 12/1998
JP 63183714 A * 7/1988

* cited by examiner

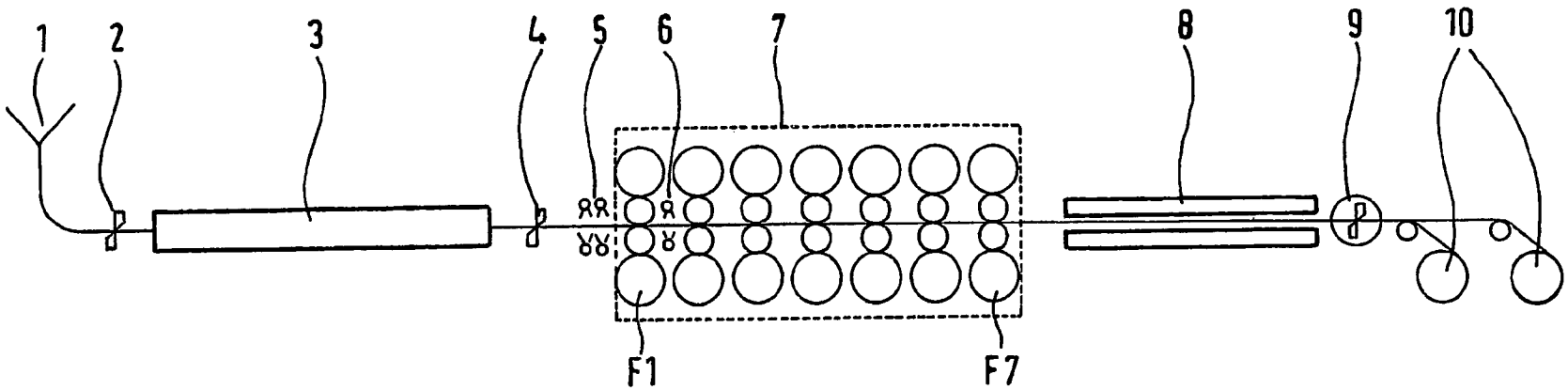
1
2
3
4
5
6
7
8
9
10
F1
F7

HOT ROLLING INSTALLATION

The invention concerns a hot rolling installation for rolling thin hot strip for a wide variety of materials that can be deformed with varying degrees of difficulty and a method of operating a hot rolling installation of this type.

Seven-stand hot rolled strip trains are known, which are located after continuous casting installations and soaking furnaces. Hot rolled strip made of materials that can be deformed with varying degrees of difficulty can be rolled with these types of hot rolling installations in thicknesses of 1.5 to 1.2 mm, and the strip still has austenitic microstructure at the outlet of the last rolling stand. The strip speed at the outlet of the last rolling stand can also be controlled with simply designed units of machinery following the hot rolling installation, such as shears and coilers.

A further reduction in the thickness of the rolled strip is not possible with these trains, at least for readily deformable materials. There are several reasons for this. On the one hand, the mean temperature of the strip at the outlet of the last rolling stand of the hot rolled strip train must not fall below the temperature (about 860° C.) required for austenitic rolling, and, on the other hand, the speed at the outlet of the last stand of the hot rolled strip finishing train should not exceed about 12.5 m/s, since otherwise the hot strip can no longer be perfectly guided by simple means on the delivery roller table and subsequently coiled. Furthermore, coilers that must be accelerated to peripheral speeds of more than 15 m/s for coiling the strip are complicated, expensive, and difficult to control.

If readily deformable material is to be rolled in the austenitic range to thicknesses below 1.2 mm, and especially below 1 mm, these previously known installations result in delivery speeds from the last stand of more than 15 m/s. If slower delivery speeds are set, the strip temperature in the last stands already falls below the temperature required for austenitic rolling, i.e., austenitic rolling no longer occurs.

When material that is more difficult to deform is being rolled, thicknesses even smaller than 1.2 mm can be achieved with the seven-stand hot rolled strip trains, since, as a result of the great rolling energy, austenitic microstructure can still be found after the last rolling stand even at lower speeds. However, the hot rolling installation is not suitable for readily deformable material with small final thicknesses.

It is already known that seven-stand rolling trains of this type can be started up at a low speed, and then the entire installation can be accelerated after the buildup of tension by the coiler. The strip rolled during the acceleration phase often must be discarded, so that installations of this type operate inefficiently.

Furthermore, especially the drive elements of the hot rolling installation are subjected to greater stress and faster wear at higher speeds, so that expensive drive components, coilers, and shears, and considerably more exact and more dynamic control mechanisms must be provided to ensure the desired strip quality.

The objective of the invention is to design a hot rolling installation and a method of operating the hot rolling installation in such a way that, even in the rolling of readily deformable materials, after the rolling operation at delivery thicknesses below 1.2 mm, and especially below 1 mm, the strip temperatures are still high enough to ensure austenitic rolling, and yet the delivery speed of the rolled strip does not exceed 15 m/s, so that more easily controllable operating sequences are obtained, installation wear is reduced, and the costs can also be kept low with simply designed units of machinery.

This objective is achieved by a hot rolling installation with the features of Claim 1. Of course, this rolling installation allows hot rolled strip of varying degrees of deformability to be rolled to thicknesses down to about 1.2 mm without any problem. However, even rolled strip thicknesses below 1.2 mm, and especially below 1 mm, can be rolled with acceptable expense by the combination of the features of the invention for materials that can be deformed with varying degrees of difficulty.

The invention is explained in greater detail below with reference to the drawing. The drawing shows a hot rolling installation, which can be operated in each case for materials that can be deformed with varying degrees of difficulty in such a way that, regardless of the material that is used and despite the different conditions that thus become established for all of the materials, the final rolling temperatures that occur at the last stand ensure austenitic rolling, and speeds less than about 15 m/s are achieved.

The hot rolling installation consists of a thin slab casting line 1, whose strand guide can be controlled in such a way that thin slab thicknesses of about 45 to 70 mm are obtained at the outlet of the thin slab casting line 1. The continuously cast thin slabs can be cut by a shear 2. The slabs can be adjusted to lengths that correspond to the length of a finished coil or a multiple thereof. The cut slabs are maintained at a temperature of, e.g., 1,150° C. in a roller hearth furnace 3 to effect temperature equalization. The roller hearth furnace 3 is followed by a shear 4, which is used only in the event of damage.

The roller hearth furnace 3 is followed by a descaling sprayer 5, which is followed by a seven-stand rolling train 7 with the rolling stands F1 to F7. The outlet of the rolling train 7 is followed by a cooling line 8, which is followed in the direction of strip flow by a flying shear 9, which is used in the case of semicontinuous or continuous rolling. The hot rolling installation ends with two coilers 10, which may be alternatively designed as a rotary coiler.

An inter stand descaling device 6 is positioned between rolling stand F1 and rolling stand F2.

Depending on the material and the desired final thicknesses, various rolling methods are possible:

If materials that are difficult to deform are to be rolled, then the thin slab casting line 1 is adjusted in such a way that, depending on the desired final thickness and casting machine output, slabs with thicknesses of 45 to 70 mm, and preferably 55 mm, are used. All seven stands F1 to F7 are engaged. The inter stand descaling device 6 is inactive. In this type of operation, the high rolling forces and the large amount of energy to be introduced into the difficulty deformable material that is to be rolled make it possible to achieve rolled strip thicknesses at the outlet of rolling stand F7 of less than 1 mm, while a speed of about 15 m/s is not exceeded, and yet rolled strip with austenitic microstructure is obtained.

If readily deformable material is to be rolled to final thicknesses>1 mm, then thin slab thicknesses of 55 to 70 mm are selected. All of the stands F1 to F7 are active, while the inter stand descaling device 6 is inactive.

During the rolling of readily deformable material with final thicknesses below 1 mm, the thin slab casting line 1 must be adjusted to thin slab thicknesses of 45 to 50 mm. The rolling stand F1 is either inactive or engaged for a skin pass with low reduction. The skin pass causes the slab surface to become smoother, so that a more uniform layer of scale can develop after the descaling sprayer 5. The active inter stand descaling device 6 can thus more easily remove the newly formed scale, i.e., less descaling agent is applied to the slabs than if the stand F1 were not adjusted for a skin pass.

The stands F2 to F7 are usually engaged slightly more strongly than in the operation in which all seven stands are engaged. As a result of the fact that only stands F2 to F7 are operated, lower final rolling speeds are achieved. However, due to the smaller entry slab thickness and the stronger engagement of stands F2 to F7, final rolling thicknesses of less than 1 mm are achieved, and the rolling stock has temperatures in the austenitic microstructure range.

The hot rolling installation of the invention thus makes it possible to roll both readily deformable and difficulty deformable materials to thicknesses of less than 1 mm in the austenitic range, without the delivery speed at rolling stand F7 exceeding 15 m/s. The entire process can thus be simply designed, and the units of machinery of the hot rolling installation, such as shears and coilers, retain their simple, cost-effective design. Increased expenditure of work is not necessary.

LIST OF REFERENCE NUMBERS

1. thin slab casting line
2. shear
3. roller hearth furnace
4. emergency shear
5. descaling sprayer
6. inter stand descaling device
7. rolling train
8. cooling line
9. flying shear
10. coiler

The invention claimed is:

1. Hot rolling installation for rolling thin hot strip for a wide variety of rolling stock made of materials that can be deformed with varying degrees of difficulty, wherein the combination of the following features:

a thin slab casting line (1) for continuous slab casting, a shear (2) following the thin slab casting line (1) for cutting the continuously cast slabs into desired lengths, which correspond to the length of a finished coil or a multiple thereof, a roller hearth furnace (3) for buffering and tempering the cut slabs, a descaling sprayer (5) and a seven-stand rolling train (7) following the roller hearth furnace (3), with an inter stand escaling device (6) provided between the first stand (F1) and the second stand (F2) of the rolling train (7), with a cooling line (8) located at the end of the rolling train (7), a shear (9) for cutting the semicontinuously or continuously rolled strip, and at least one coiler (10) for coiling the strip into coils, in which the thin slab casting line (1) has an adjustable strand guide.

2. Method of operating a hot rolling installation in accordance with claim 1, wherein, to roll thin strips of a readily deformable material, the second to seventh rolling stands (F2 to F7) are engaged for rolling in such a way that, at a given furnace temperature, rolled strip with austenitic microstructure is obtained at a controllable speed at the outlet of the seventh rolling stand (F7), that the first rolling stand (F1) is open, and that the interstand descaling device (6) is loaded in such a way that the scale newly formed between the descaling sprayer (5) and the interstand descaling device (6) is removed from the slabs.

3. Method in accordance with claim 2, wherein the first stand (F1) is engaged for a skin pass.

4. Method for operating a hot rolling installation in accordance with claim 1, wherein, to roll thin strips of a material that is difficult to deform, all of the rolling stands (F1 to F7) are engaged for rolling in such a way that, at a given furnace temperature, rolled strip with austenitic microstructure is obtained at controllable speeds at the outlet of the seventh rolling stand (F7), and that the interstand descaling device (6) is shut off.

5. Method in accordance with claim 2, wherein the furnace temperature is about 1,150° C., the outlet temperature of the rolled strip after the last rolling stand (F7) does not fall below the temperature required for austenitic rolling, and the controllable strip speed is up to about 15 m/s.

* * * * *